US008585179B2

(12) United States Patent
Panchawagh et al.

(10) Patent No.: US 8,585,179 B2
(45) Date of Patent: Nov. 19, 2013

(54) FLUID FLOW IN MICROFLUIDIC DEVICES

(75) Inventors: Hrishikesh V. Panchawagh, Rochester, NY (US); Jeremy M. Grace, Penfield, NY (US); Randolph C. Brost, Albuquerque, NM (US)

(73) Assignee: Eastman Kodak Company, Rochester, NY (US)

( * ) Notice: Subject to any disclaimer, the term of this patent is extended or adjusted under 35 U.S.C. 154(b) by 1374 days.

(21) Appl. No.: 12/057,929

(22) Filed: Mar. 28, 2008

(65) Prior Publication Data

US 2009/0244180 A1 Oct. 1, 2009

(51) Int. Cl.
*B41J 2/135* (2006.01)

(52) U.S. Cl.
USPC ..... 347/44; 347/73

(58) Field of Classification Search
USPC ..... 347/44, 73
See application file for complete search history.

(56) References Cited

U.S. PATENT DOCUMENTS

| | | | |
|---|---|---|---|
| 1,941,001 | A | 12/1933 | Hansell |
| 3,373,437 | A | 3/1968 | Sweet et al. |
| 3,416,153 | A | 12/1968 | Hertz |
| 3,946,398 | A | 3/1976 | Kyser |
| 4,080,607 | A | 3/1978 | Van Breemen et al. |
| 4,260,996 | A | 4/1981 | Wittwer |
| 4,346,387 | A | 8/1982 | Hertz |
| 4,460,903 | A | 7/1984 | Guenther et al. |
| 5,475,409 | A | 12/1995 | Simon et al. |
| 5,501,893 | A | 3/1996 | Laermer et al. |
| 5,880,759 | A | 3/1999 | Silverbrook |
| 6,051,503 | A | 4/2000 | Bhardwaj et al. |
| 6,079,821 | A | 6/2000 | Chwalek et al. |
| 6,234,620 | B1 | 5/2001 | Faisst, Jr. et al. |
| 6,382,782 | B1 | 5/2002 | Anagnostopoulos et al. |
| 6,439,703 | B1 | 8/2002 | Anagnostopoulos et al. |
| 6,450,619 | B1 | 9/2002 | Anagnostopoulos et al. |
| 6,497,510 | B1 | 12/2002 | Delametter et al. |
| 6,554,410 | B2 | 4/2003 | Jeanmaire et al. |
| 6,663,221 | B2 | 12/2003 | Anagnostopoulos et al. |
| 6,866,370 | B2 | 3/2005 | Jeanmaire |
| 6,984,028 | B2 | 1/2006 | Steiner |
| 7,399,068 | B2 * | 7/2008 | Anagnostopoulos et al. .. 347/73 |
| 7,758,155 | B2 | 7/2010 | Anagnostopoulos |
| 2006/0197810 | A1 | 9/2006 | Anagnostopoulos et al. |
| 2008/0284835 | A1 | 11/2008 | Panchawagh et al. |

FOREIGN PATENT DOCUMENTS

| | | |
|---|---|---|
| DE | 42 41 045 C1 | 12/1992 |
| EP | 1 431 039 A1 | 6/2004 |
| GB | 2007162 | 5/1979 |

(Continued)

OTHER PUBLICATIONS

Miki, Zhang et al, Multi-stack silicon-direct wafer bonding for 3D MEMS manufacturing, 2003 Elsevier Science B.V., US.

(Continued)

*Primary Examiner* — Kevin S Wood
(74) *Attorney, Agent, or Firm* — William R. Zimmerli

(57) ABSTRACT

A microfluidic device comprising a monolithic superstructure, wherein the superstructure contains fluid channels, and in at least one of the fluid channels, in an area where the channel changes direction or intersects another channel, the channel is greater in cross-section than in other areas of said channel.

A microfluidic device superstructure comprising fluid channels wherein said channels comprise projections into at least part of the channel to aid in laminar flow of fluid.

24 Claims, 8 Drawing Sheets

(56) References Cited

FOREIGN PATENT DOCUMENTS

WO WO 2008/143787 A1 11/2008
WO WO 2008/143788 A2 11/2008
WO WO 2009/017611 A1 2/2009

OTHER PUBLICATIONS

Miki, Zhang et al, A Study of Multi-Stack Silicon-Direct Wafer Bonding for MEMS Manufacturing, 2002 IEEE, US.

* cited by examiner

FLUID FLOW IN MICROFLUIDIC DEVICES

FIELD OF THE INVENTION

This invention relates to the field of inkjet printing heads and other microfluidic devices. The invention particularly relates to continuous inkjet printheads with integrally formed structures for print drop selection and guttering of non-print drops.

BACKGROUND OF THE INVENTION

U.S. Pat. No. 6,079,821 issued to Chwalek et al. discloses a continuous inkjet printhead in which deflection of selected droplets is accomplished by asymmetric heating of the jet exiting the orifice.

U.S. Pat. No. 6,554,410 by Jeanmaire et al. teaches an improved method of deflecting the selected droplets. This method involves breaking up each jet into small and large drops and creating an air or gas crossflow relative to the direction of the flight of the drops that causes the small drops to deflect into a gutter or ink catcher while the large ones bypass it and land on the medium to write the desired image or the reverse, that is, the large drops are caught by the gutter and the small ones reach the medium.

U.S. Pat. No. 6,450,619 to Anagnostopoulos et al. discloses a method of fabricating nozzle plates, using CMOS and MEMS technologies which can be used in the above printhead. Further, in U.S. Pat. No. 6,663,221, issued to Anagnostopoulos et al., methods are disclosed of fabricating page wide nozzle plates, whereby page wide means nozzle plates that are about 4 inches long and longer. A nozzle plate, as defined here, consists of an array of nozzles and each nozzle has an exit orifice around which, and in close proximity, is a heater. Logic circuits addressing each heater and drivers to provide current to the heater may be located on the same substrate as the heater or may be external to it.

For a complete continuous inkjet printhead, besides the nozzle plate and its associated electronics, a means to deflect the selected droplets is required, an ink gutter or catcher to collect the unselected droplets, an ink recirculation or disposal system, various air and ink filters, ink and air supply means and other mounting and aligning hardware are needed.

In these continuous inkjet printheads the nozzles in the nozzle plates are arranged in a straight line, their pitch is between about 150 and 2400 per inch and, depending on the exit orifice diameter, they can produce droplets as large as about 100 pico liters and as small as 0.1 pico liter.

As already mentioned, in all continuous inkjet printheads, including those that depend on electrostatic deflection of the selected droplets (see for example U.S. Pat. No. 5,475,409 issued to Simon et al.), an ink gutter or catcher is needed to collect the unselected droplets. Such a gutter has to be carefully aligned relative to the nozzle array since the angular separation between the selected and unselected droplets is, typically, only a few degrees. The alignment process is typically very laborious if done manually and requires precision-machined components for an automatic kinematic alignment, which results in a substantial increase in the cost of print production labor and cost of the print head. Also, the overall print engine cost is increased because each gutter must be aligned to its corresponding nozzle plate individually with separate kinematic alignment components.

The gutter or catcher may contain a knife-edge or some other type of edge or surface to collect the unselected droplets and that edge or surface has to be straight to within a few tens of microns from one end to the other. Gutters are typically made of materials that are different from the nozzle plate and as such they have different thermal coefficients of expansion. Therefore, changes in ambient temperature can produce sufficient misalignment of gutter and nozzle array to cause the printhead to fail. Since the gutter is typically attached to some frame using alignment screws, the alignment can be lost if the printhead assembly is subjected to shocks and vibration as can happen during shipment or operation.

The U.S. publication 2006/0197810 A1-Anagnostopoulos et al. discloses an integral printhead member containing a row of inkjet orifices.

Earlier coassigned filed application Ser. No. 11/748,663, filed May 15, 2007 titled "An Integral Micromachined Gutter for Inkjet Printhead" and application Ser. No. 11/748,620 filed May 15, 2007 titled "Monolithic Printhead with Multiple Row of Inkjet Orifices" are related to this application and disclose formation of silicon printheads with integral gutters and air channels.

The inkjet printhead is an example of a microfluidic device. Microfluidic devices are devices having a network of channels or conduits or flow paths, or otherwise defined regions of fluid flow, wherein at least one dimension is of order 1 mm or less, and in which fluid must travel for intended operation of the devices. The present invention is also relevant to any microfluidic device in which controlled flow of gases or liquids is required and the flow regimes are such that turbulence causes adverse effects on flow uniformity or control. There is a need to decrease fluid turbulence in microfluidic devices.

SUMMARY OF THE INVENTION

A microfluidic device comprising a monolithic superstructure, wherein the superstructure contains fluid channels, and in at least one of the fluid channels, in an area where the channel changes direction or intersects another channel, the channel is greater in cross-section than in other areas of said channel.

In another embodiment of the invention, a microfluidic device comprising fluid channels where said channels comprise projections into at least part of the channel to aid in a uniform laminar flow of fluid over the entire length of the printhead.

DETAILED DESCRIPTION OF THE INVENTION

Figure 1:
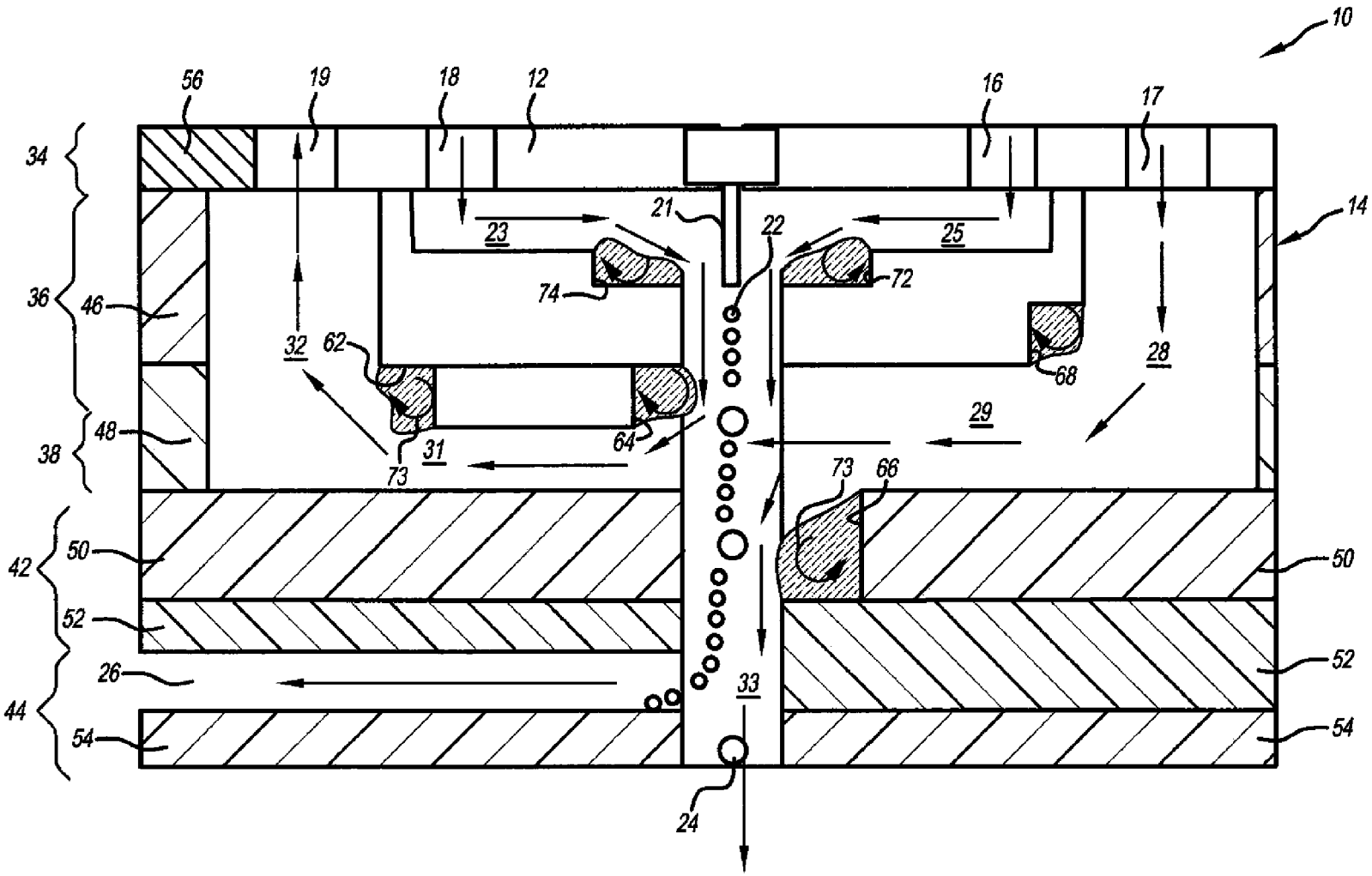
FIG. 1 is a schematic partial cross-section of a printhead with notches to improve airflow.

The invention has numerous advantages over the prior practices. The invention inkjet printhead has improved flow of ink droplets from the inkjet printhead because the flow of gases is less turbulent. Further, the airflow is improved even though the superstructure containing the channels for airflow is formed of a silicon wafer structure wherein etching is not able to produce rounded corners in channels. As is known etching silicon wafers produces only Manhattan skyline type structures with raised and lowered portions joining each other at right angles. These and other advantages of the invention will be apparent from the Figures and the description below.

The invention provides a method to achieve improved airflow in silicon monolithic micromachined structures forming a fluidic network. More generally, a microfluidic device comprising a monolithic superstructure, 3-dimensional network of fluid channels, and means to improve laminar fluid flow are embodied in this invention. The phrases such as "monolithic silicon superstructure" and "monolithic micromachined structures" refer to structures for inkjet printheads or other microfluidic devices that are formed by bonding together wafers of machined material to form a unitary monolithic structure containing channels needed for an inkjet head or other microfluidic device. In a preferred form the monolithic structures or superstructures are formed of silicon wafers that are machined by a process such as Deep Reactive Ion Etch (DRIE) and then bonded together. The improved airflow is an advantage in the utilization of these structures for printhead superstructures.

In the present art, the interaction between the moving ink drops and the surrounding gas flow is crucial in determining the ink drop trajectory and hence the print quality. For example, airflow aligned to the motion of the ink drops, called collinear airflow, helps to reduce adverse drag effects and consequent slowing of ink drops as they move towards the media. In cases where air or gas flow is used for drop separation, gas flow is also employed across the motion of the ink drops. This cross flow air is called deflection air. Instabilities or disturbances in the collinear or deflection airflows result in errors in ink drop position. Typically, this is avoided by using moderate airflows and aerodynamically shaped gas conduits and by maintaining the flow in the laminar flow regime. In addition, other features such as screens and compression zones are used upstream of the printhead to pre-condition air to suppress turbulence arising from instabilities or disturbances in the source pressure and air flow.

In silicon micromachined integrated continuous inkjet printheads, "Manhattan" like geometries are most common. The "Manhattan" geometry is characterized by rectangular features having steep sidewalls. In order to maintain feature widths, highly anisotropic etching processes are commonly used. The Deep Reactive Ion Etch (DRIE) processes used to machine silicon wafers that create the integrated print head are highly anisotropic etch processes that create "Manhattan" like geometries. Although there are other processes that can etch angled walls in silicon, DRIE is a preferred process for etching silicon as it is more suitable for high volume manufacturing and is available commercially from most silicon foundries. The present invention overcomes this limitation of silicon fabrication by adding design features to minimize unsteady gas flow experienced by ink drops. First, it is important to minimize turbulence (random, three-dimensional motion of fluid particles in addition to mean motion) by maintaining the gas flow in a laminar regime, where the gas flow is characterized by smooth motion in laminates or layers. The turbulent and laminar regimes are determined by Reynolds number (Re), which is a dimensionless parameter defined as the ratio of inertial force to viscous force in a given flow field. Re is calculated as $Re=\rho UD/\mu$, where $\rho$ is the fluid density, U is the velocity magnitude, D is the characteristic dimension defining the flow geometry, and $\mu$ is the fluid dynamic viscosity. In general the flow is laminar at lower values of Re and turns to turbulent at high values of Re. For internal pipe flows, the critical value of Re above which the flow transitions to turbulent is around 2000-2300. Therefore, for a given gas, dimension D is designed such that flow is in the laminar range for the required gas velocity U. However, there are many sources of flow disturbance in the integrated silicon printhead due to its Manhattan geometry. These include sudden expansion zones, flow mixing zones, sharp turns, and sharp edges in the flow path. The device described in this invention addresses this issue. The invention provides an increase in the cross-section of at least one channel in the printhead where the channel bends or where the channel crosses or intersects with another channel. The channel would have an enlarged cross-section area at bends. The channel increase may be in the area, or mouth, at the intersection with another channel. Another advantage of the current device is the integrated micromachined flow straighteners and screens (i.e. flow conditioning aids) that reduce the flow disturbances coming from the source and the tortuous path in the device. These flow conditioning aids are preferably located just before the gas enters the main channel, where it interacts with the ink drops, thus reducing the adverse effect on drop motion. These and other advantages of the invention will be apparent from the Figures and the description below.

FIG. 1 illustrates a printhead in accordance with the present invention. The printhead is composed of a nozzle plate 12 and a printhead superstructure 14. The term "superstructure" as used herein refers to the part of a printhead that is below or partially surrounding the nozzle. The printhead itself includes the superstructure with a nozzle plate and manifold (not shown) for feeding and retrieving ink and gas to the nozzle plate. The nozzleplate is provided with channel 16 and/or 18 for entry of air from the manifold to provide an airflow that is collinear with the ink streams while channel 17 is provided to introduce air that is used for deflection of ink drops. The ink stream is composed of small drops 22 and large drops 24. Small drops 22 are separated from the large drops 24 by cross directional airflow entering channel 28 and 29 and leaving through cross directional airflow exit channel 31 and 32. In general, the large drops 24 exit the printhead and attach to media, not shown, moving beneath the printhead. Small drops enter gutter channel 26 and are returned for recycling through channel 26. The speed of the ink drops may range from 10-30 meters per second when they leave the nozzle and the speed of the air collinear with the ink streams in channel 33 is generally intended to match the speed of the drops so as to not disturb their movement. The air used for drop deflection is preferably moving at an average speed of between 5 and 50 meters per second for separating large and small drops. The printhead may be divided into the following sections: drop generator 34, ink drop formation area 36, deflection zone 38, drop separation zone 42, and gutter 44.

The superstructure 14 of the printhead is formed of silicon wafers 46, 48, 50, 52, and 54 joined to form a monolithic assembly. The superstructure 14 is joined to the wafer 56 comprising the inkjet nozzle plate 12. Shown in FIG. 1 is a partial cross-sectional view of an array of nozzles 21. It is to be understood that the channels 28, 29, 31, 32, 33, and 28 would extend the length of the nozzle array, supported at the two ends. Channels 16, 17, 18, 19 may be continuous, with systematic segmentation over the length of array to avoid CMOS circuitry and electrical interconnections in the nozzleplate. Typically, ports 16, 17, and 18 are maintained at a positive pressure with respect atmospheric pressure while port 19 is maintained at reduced pressure by connection to a vacuum pump. In general, the channel 29 feeding the deflection air into and across the main channel 33 is designed to have a larger cross-section than channel 31.

The invention relates to control of the flow in the channels of the superstructure 14. The airflow channels are provided with notches 62, 64, 66, 68, 72, and 74 where the channels change direction (in this case, make a 90-degree turns) or intersect with other channels. These notches remove the sharp edges that cause adverse flows in the ink stream path and create intentional flow separation and recirculation zones 73. These recirculation zones act as an artificial wall for the main gas flow and help to make a gradual transition in the flow direction. The arrows in FIG. 1 indicate the direction of airflow in the main channels and in the recirculation zones. The result is that the airflow is relatively steadier in channel 33 where the ink drops interact with air. The shape of the notches is generally rectangular and their size is selected depending on the channel size before and after the turn as well as fabrication process limitations. In general, the length of the notch along the wider channel is designed to be longer than the length of the notch along the narrower channel. An effective notch is between 0.5 and 1.5 the width of the channel in which it is located.

Figure 1B:
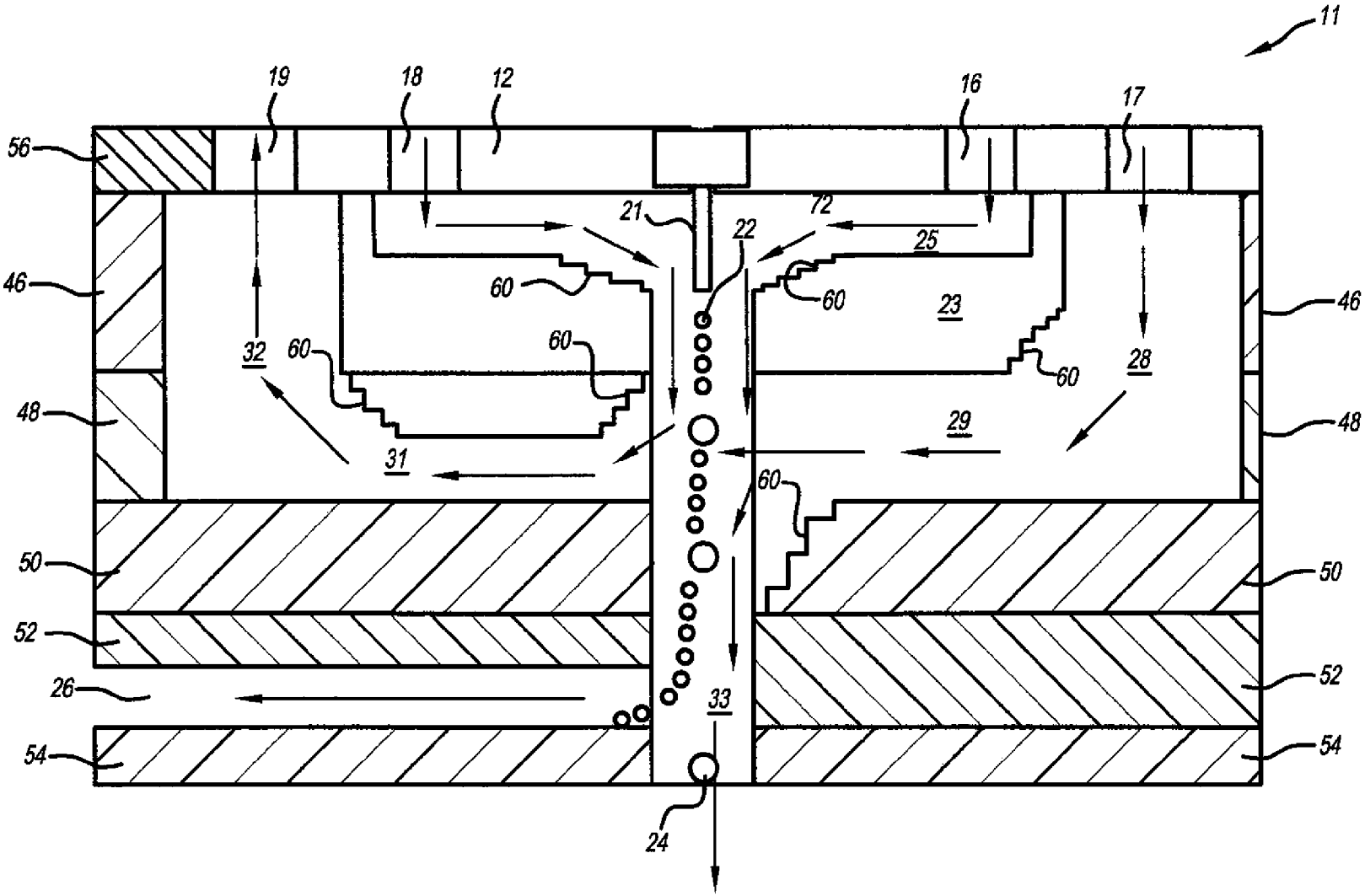
FIG. 1*b* is a schematic partial cross-section of a printhead with steps in the area of greater cross-section.

It is understood that the notches each of 62, 64, 66, 68, 72, and 74 can be divided into notches formed of small steps 60 as shown in FIG. 1*b*.

Figure 2:
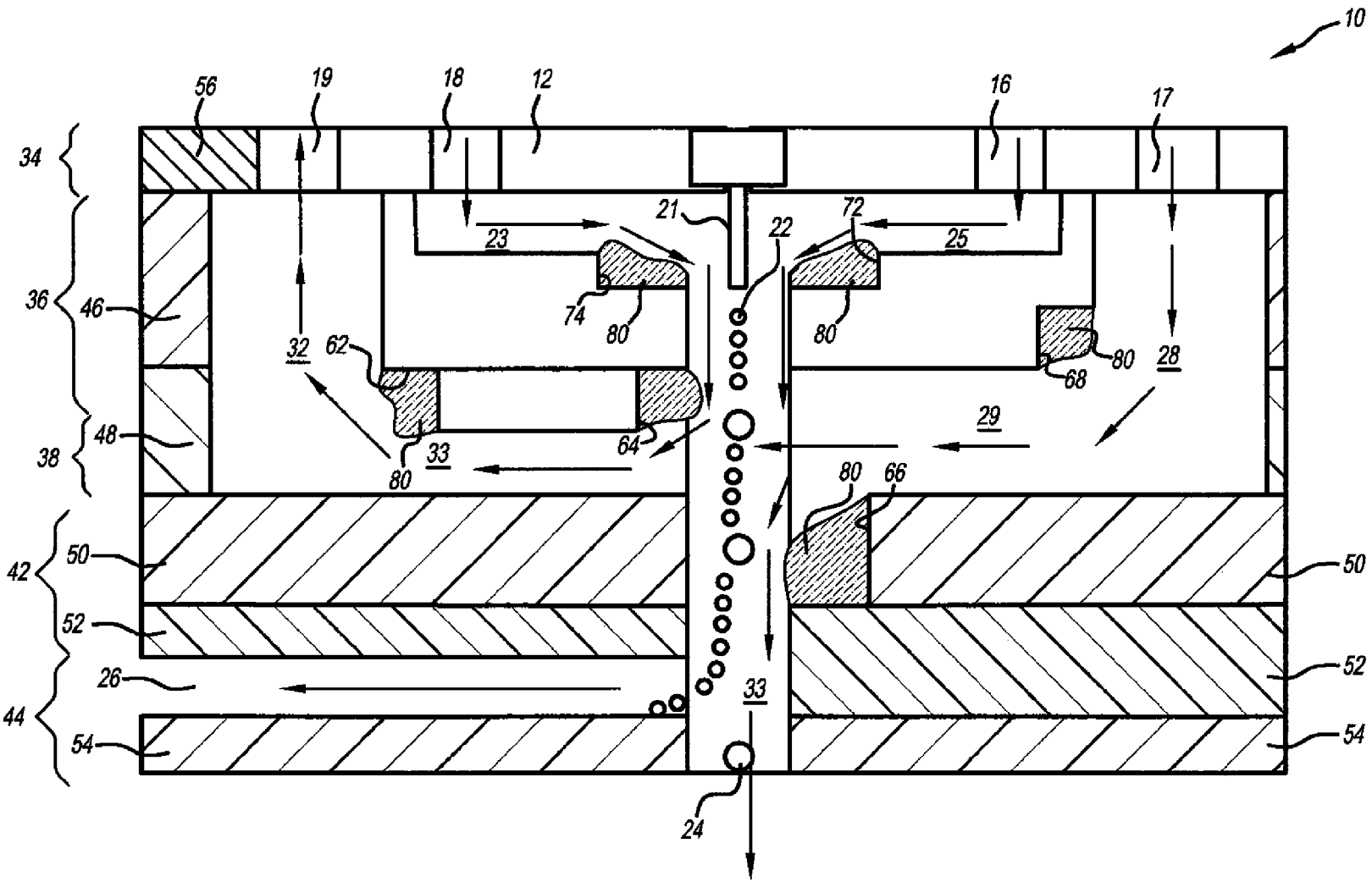
FIG. 2 is a schematic partial cross-section of a printhead with polymer in the notches.

In FIG. 2 the printhead 10 is illustrated with polymer 80 partially filling notches 72, 74, 62, 68, 64, and 66. The polymer provides a rounded surface that is not possible to directly form by the DRIE and other methods of forming silicon wafers. The polymer may be placed into the superstructure of the printhead by passing polymer material through the appropriate channels so that polymer adheres to the walls and starts curing. This step is followed by flowing a solvent through the device, thereby removing most of the polymer material, while leaving polymer in the notch areas, where the interaction between the solvent and polymer filler material is less. The polymer is later cured in situ to permanently fill the notch areas. It is also possible that the individual wafers and partially assembled stacks of wafers prior to being formed into the monolithic superstructure are spin coated with the polymer, which will be captured in the notches.

Polymer materials suitable for passing through the superstructure to form the rounded filling in the notches may be any suitable material. Typical examples of such materials are thick photoresist SU-8 and polyimide. The preferred material is the polyimide because this material effectively gathers in the notches and it may be placed in the channels by spin-coating.

Figure 3:
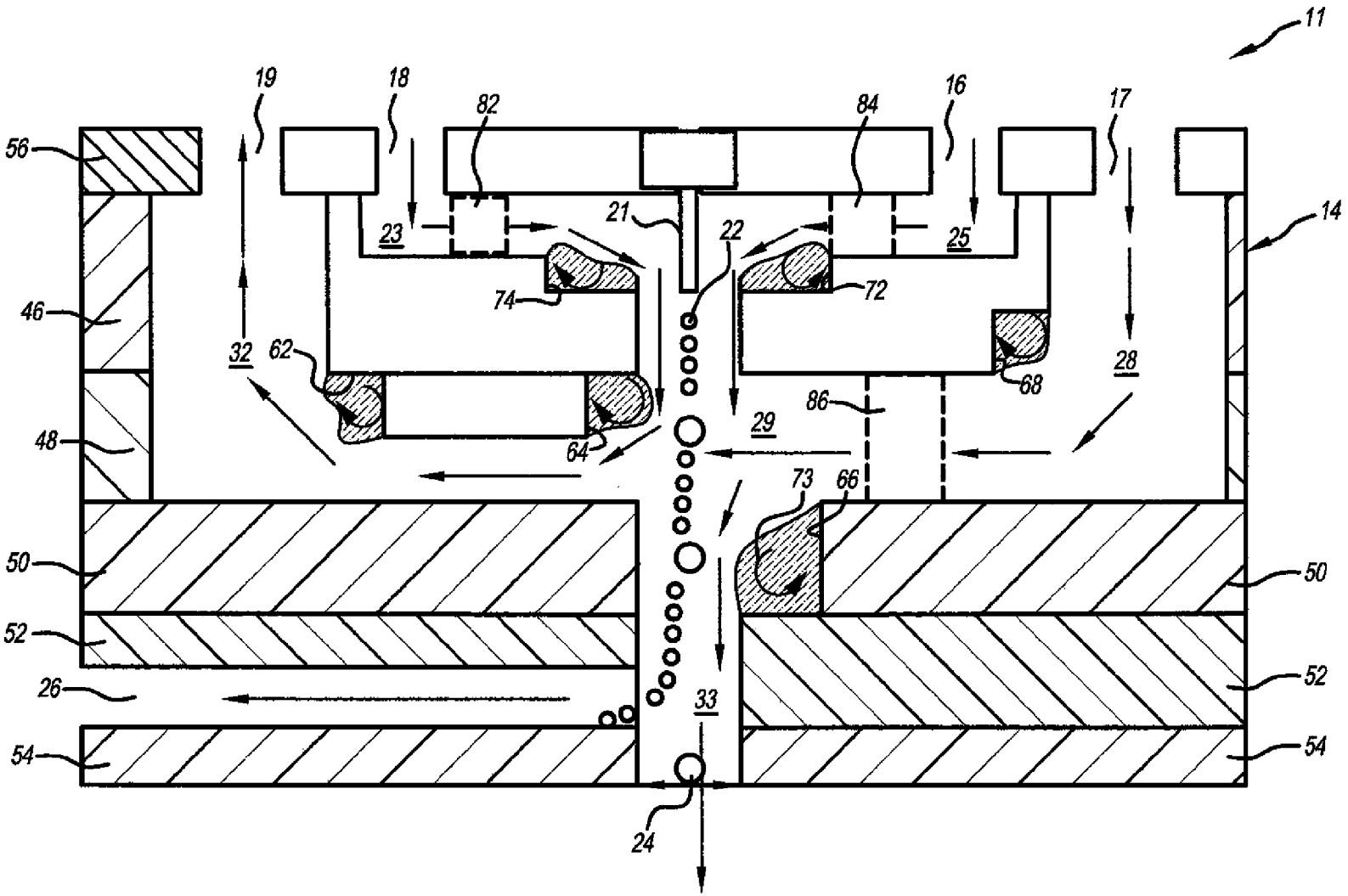
FIG. 3 is a schematic partial cross-section of an inkjet printhead with projections (flow conditioning aids) to reduce turbulence and create uniform flow in the channels.

In FIG. 3 is another embodiment of a printhead 11 with a superstructure containing change-of-direction notches with built in flow conditioning aids that serve to improve the flow uniformity and make the flow laminar. Structures in FIG. 3 correspond to those in FIG. 1 when labeled with like numbers. Printhead 11 is provided with projections 82, 84 and 86 that equalize the pressure on the upstream side over the length of the printhead by restricting the flow. By compressing the flow, these features also reduce turbulent airflow, caused by narrow openings 16, 17 and 18 into the printhead. In addition, these flow-conditioning structures reduce the characteristic dimension of the airflow in the channel and therefore maintain a low Reynolds number and laminar airflow. These structures are designed such that their effective cross-sectional area (i.e. open area normal to the airflow, for example open area between projections 86 in channel 29 or combined open area between projections 82 and 84 in respective channels 23 and 25) is higher than that of the main channel 33 and the exiting air does not become turbulent.

Figure 4:
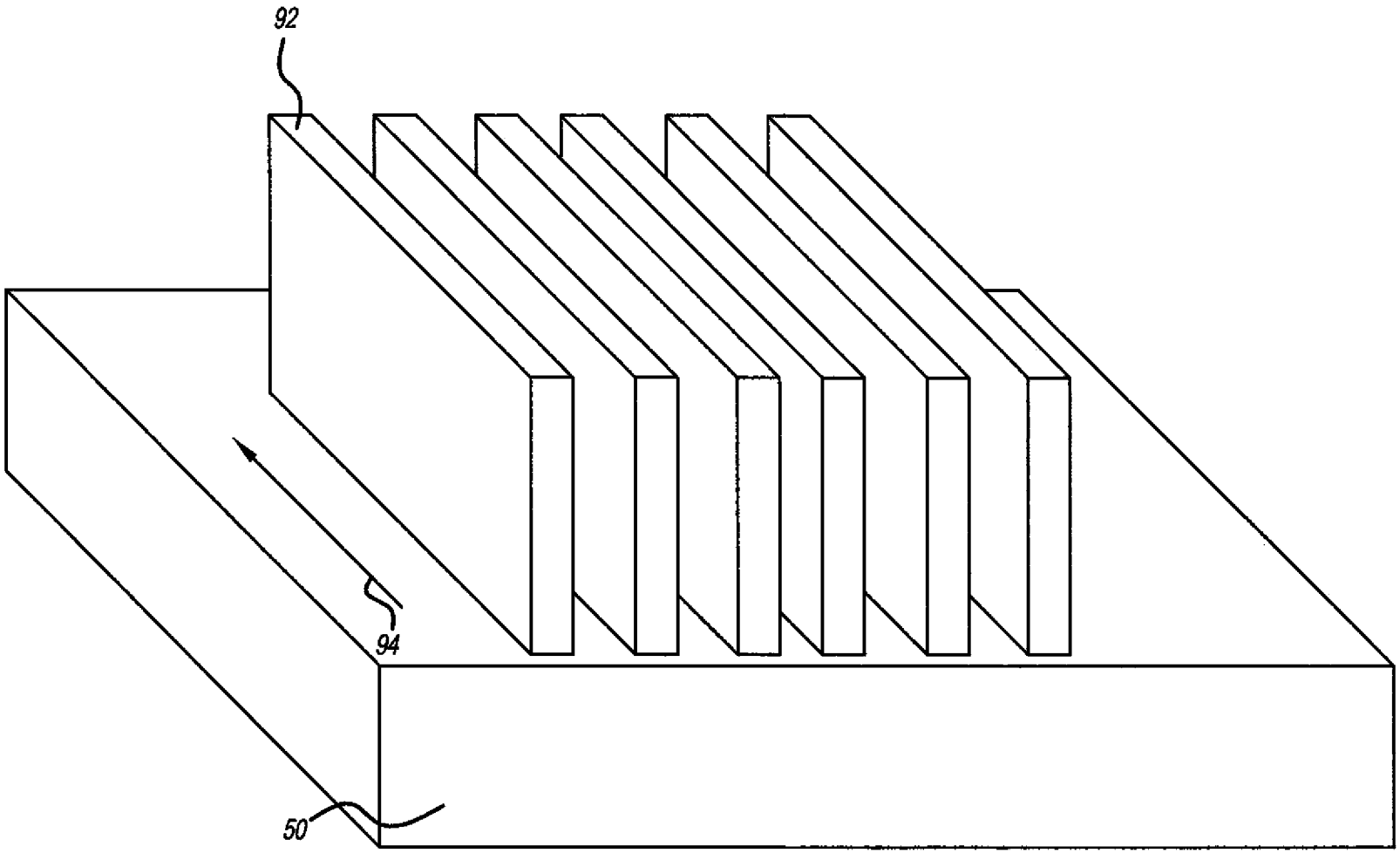
FIG. 4 and FIG. 5 are partial perspective views of flow conditioning aids prior to printhead assembly.

The flow conditioning aids consist of vertical parallel ribs placed in the channels 23 and 25 for the incoming air for the ink stream channel 33 and the cross direction air in channel 29. These projections, 82, 84 and 86 are etched in silicon wafers 46 and 48 and can have a variety of geometrical configurations, including vertical ribs or posts of rectangular, square, or other cross-sectional shape. FIG. 4 is a perspective view with a portion of a channel on wafer 48 with the formation of vertical ribs 92. These ribs can be made with the silicon wafers along with the other channel structures as they have a vertical profile that can be etched using the same DRIE process. While the ribs have been shown for use with the notched corners it is not necessary that the airflow aid projections be used with the notches, as their action on collinear flow is independent of the flow improvement by formation of the eddies at the change of direction of the channel. However, compared to the use of only one technique, the use of notches and flow conditioning aids in combination leads to more laminar gas flow in the region of the ink stream channel 33 where it interacts with the ink drops. The eddies in the corners of the channel are non-laminar but the combination improves laminar flow in the bulk of the channel and limits non-laminar behavior primarily to the corner eddy regions.

Figure 5:
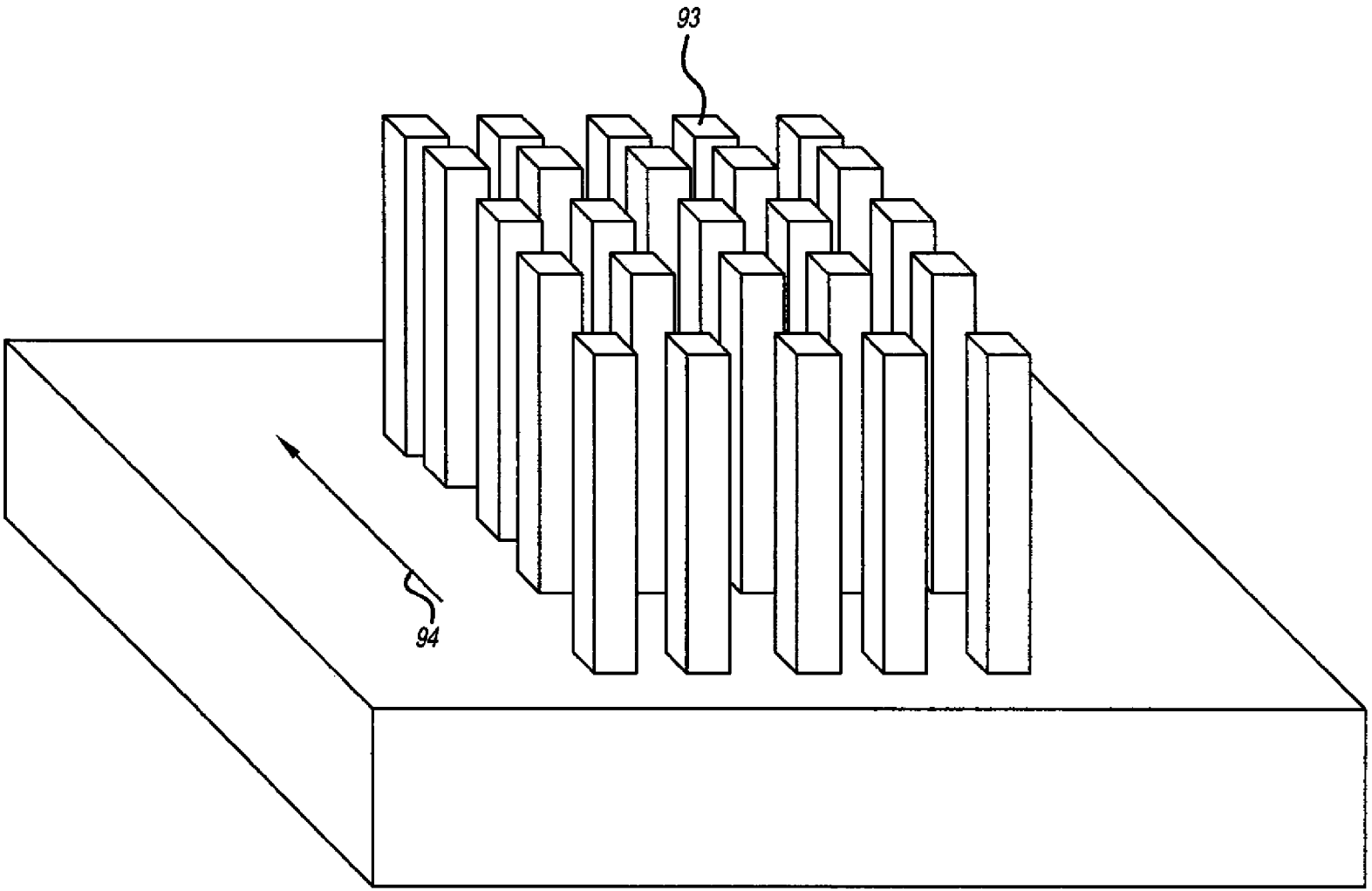

Instead of ribs, posts aligned in the direction of airflow could be utilized in the channel to aid in creating a laminar flow of the air. As illustrated in FIG. 5, there is an arrangement of posts 93 on a silicon wafer 90. The posts aligned in the direction of flow 94 would result in a reduction of turbulent flow and an increase in laminar flow. The posts or ribs as shown could extend the entire height of the channel or could only extend into a portion of the channel. The spacing of the ribs or posts is chosen to best balance the required flow rate while maintaining the Reynolds number low enough such that flow is laminar. Generally ribs would have a pitch in a range of 125 and 500 per cm. Gaps between the ribs would be between 5 and 20 μm. The spacing between rows of posts would be the same as the spacing for ribs. The posts or ribs would generally extend entirely across the width and height of the channel, although the rib and post illustrations of FIG. 4 and FIG. 5 extend only partly across the channel.

While the posts have been described as extending from one side of the channel or as being placed across the channel it is possible that the posts or ribs could extend up from the bottom of the channel and downwardly from the top. Such ribs or lines of posts could either meet or be interlocking, with the upper ribs or posts located between the lower ribs or posts. Combinations of ribs and posts also would be suitable. The rib and posts could also extend in from the sides of the channel rather than the top and bottom as illustrated.

Screens can also be formed integrally by using many small through holes in wafer 56 instead of large channels 16, 17, and 18. Theses holes can range from 10 to 100 micrometers in diameter. These screens will act in the same way as the ribs 92 or posts 93 projections at 82, 84 or 86 to further precondition the incoming air to remove turbulence and have uniform flow across the entire length of the printhead.

The integral gutter device of the invention may be formed by any of the known techniques for shaping silicon articles. These include CMOS circuit fabrication techniques, microelectromechanical structure fabrication techniques (MEMS) and others. The preferred technique has been found to be the deep reactive ion etch (DRIE) process, because, in comparison with other silicon formation techniques, the DRIE process enables more efficient fabrication of high aspect ratio structures with large etch depths (>10 micrometers) required for this device.

The techniques for creation of silicon materials involving etching several silicon wafers, which are then united in an extremely accurate manner, are particularly desirable for formation of printheads, as the distance between the nozzles of the printheads must be accurately controlled. Further, there is need to put channels for ink and air handling into the silicon structure in an accurate manner.

Figure 6A:
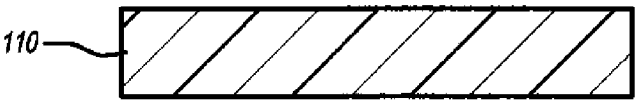
FIGS. 6A-6I are cross-sectional views of a fabrication process for silicon wafers.
Figure 6B:
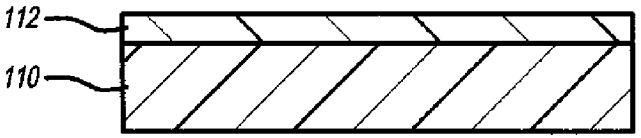
Figure 6C:
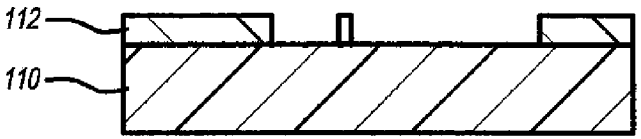
Figure 6D:
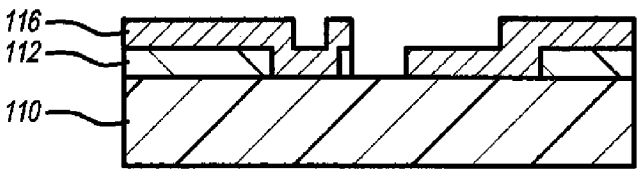
Figure 6E:
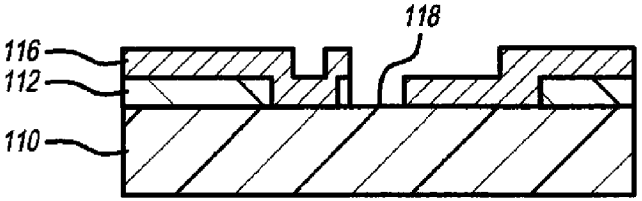
Figure 6F:
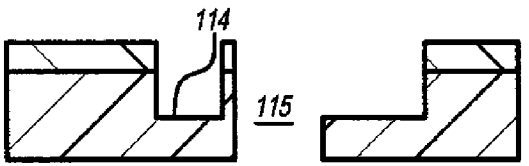
Figure 6G:
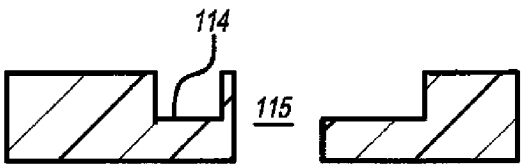
Figure 6H:
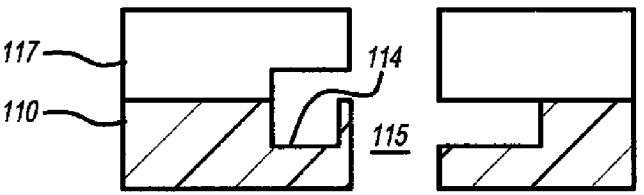

The methods and apparatus for formation of stacked chip materials are well known. In FIGS. 6A-6I there is given a brief illustration of the manufacturing process. In FIG. 6A there is shown a single wafer 110 that has no features etched into the silicon. In FIG. 6B a layer of plasma enhanced chemical vapor deposited (PECVD) silicon dioxide film 112 has been deposited on the wafer. In FIG. 6C the oxide layer has been patterned using photolithography to define partially etched areas. In FIG. 6D, the surface has been coated with a photoresist 116 on the side to be etched and then exposed in a pattern to define the regions of photoresist where etching is to take place. In FIG. 6E the wafer 110 has been partially etched to form etched hole 118 utilizing deep reactive ion etch process using the photoresist mask. In FIG. 6F after further etching has been carried out using an oxide hard mask, there is formed a hole 115 through the wafer as well as a removed part of the wafer at 114. In FIG. 6G, the oxide film has been removed to recover a formed wafer. Wafers with different etch patterns machined using this process create the integrated printhead structure. In FIG. 6H another wafer 117, already etched by the same process, is bonded to wafer 110.

Figure 6I:
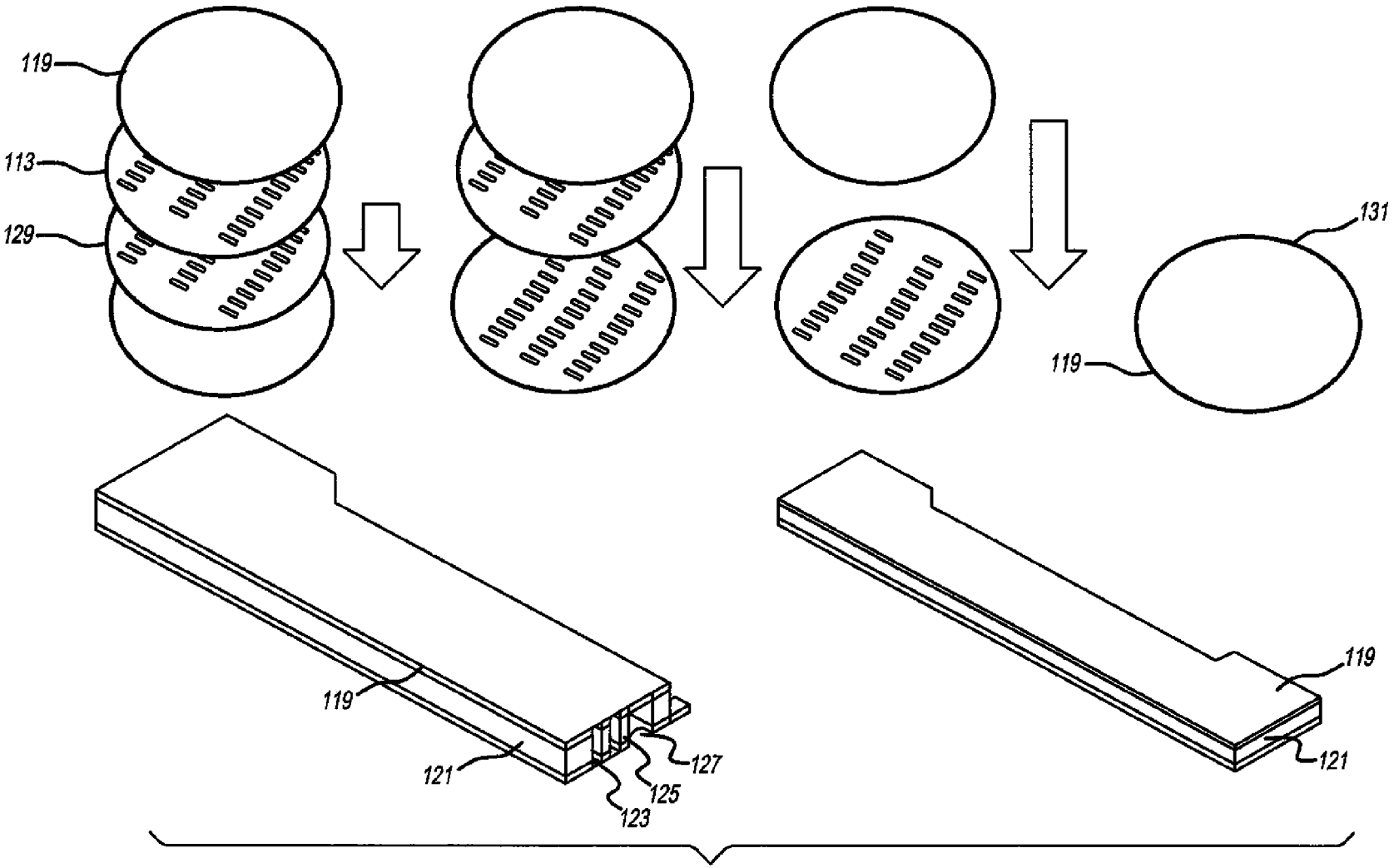

In FIG. 6I there is a perspective expanded view of the fabrication of an integral gutter device via wafer scale integration. As illustrated there are etched wafers 132, 134 and 136 that are joined to form wafer 125 that is a monolithic structure wherein openings have been formed by the individual etching steps in the separate wafers 132, 134, and 136. The printhead 119 is then fastened to manifold 121. It can be seen that manifold 121 has openings 123 and 138 which would be channels for air input and exhaust to be supplied to the printhead. Opening 127 would be an orifice in the manifold to bring fluids to the manifold or to provide suction for the ink return from the gutter. It is noted that FIG. 6I is only illustrative. The printhead of the invention as shown in FIG. 1 would generally require at least four layers of plates or wafers with etching to form the needed channels for the integral gutter silicon printhead.

While illustrated with particular inkjet printheads, the invention could be utilized in other embodiments. For example, the invention could be utilized in a printhead that printed with small drops and recycled the large drops. Furthermore, the invention could be utilized for improved fluid flow (e.g., flow of gas, liquid, or supercritical fluid) in microfluidic devices that process fluids at flow rates that, without the present invention, are sufficient to produce adverse turbulent effects. The invention could be used in microfluidic devices such as lab-on-chip devices, on-chip chemical synthesis, and microfluidic chips for biomedical applications.

PARTS LIST

| | | | |
|---|---|---|---|
| 10 | printhead | 64 | square notches |
| 11 | printhead | 66 | notches |
| 12 | nozzleplate | 68 | notches |
| 14 | printhead superstructure | 72 | notches |
| 16 | channels | 73 | recirculation zones |
| 17 | channels | 74 | notches |
| 18 | channels | 80 | notched areas filled with polymer |
| 19 | channels | 82 | flow conditioning aids |
| 21 | cross-sectional view of an array of nozzles | 84 | flow conditioning aids |

-continued

| | | | |
|---|---|---|---|
| 22 | small drops | 86 | flow conditioning aids |
| 23 | channel | 90 | silicon wafer |
| 24 | large drops | 92 | posts/vertical ribs |
| 25 | channel | 94 | flow |
| 26 | Gutter channel | 110 | single wafer |
| 28 | entering channel | 111 | etched wafer |
| 29 | channel | 112 | silicon dioxide film |
| 31 | channel | 113 | etched wafer |
| 32 | airflow exit channel | 114 | wafer |
| 33 | ink steam channel | 115 | hole |
| 34 | drop generator section | 116 | photoresist |
| 36 | drop generator section | 117 | wafer |
| 38 | ink drop formation area | 118 | partially etched hole |
| 42 | drop separation zone | 119 | printhead |
| 44 | gutter | 121 | manifold |
| 46 | silicon wafer | 123 | openings |
| 48 | silicon wafer | 125 | wafer |
| 50 | silicon wafer | 127 | openings |
| 52 | silicon wafer | 132 | etched wafer |
| 54 | silicon wafer | 134 | etched wafer |
| 56 | inkjet nozzle platen | 136 | etched wafer |
| 60 | small steps | 138 | opening |
| 62 | notches | | |

The invention claimed is:

1. A microfluidic device comprising a monolithic superstructure, wherein the superstructure contains fluid channels, and in at least one of the fluid channels, in an area where the channel changes direction or intersects another channel, the channel is greater in cross-section than in other areas of said channel, and wherein the channel is greater in cross-section because of a rectangular notch at a change of direction of a channel or intersection with another channel, and wherein the greater cross-sectional areas of the channels are partially filled with polymer.

2. The microfluidic device of claim 1 wherein the channel increase in cross-section is at the inside of the direction change.

3. The microfluidic device of claim 1 wherein the rectangular notch has a depth about equal to the width of the channel prior to the notch.

4. The microfluidic device of claim 1 wherein the depth of said rectangular notch is between 0.5 and 1.5 of the channel cross-section prior to the notch.

5. The microfluidic device of claim 1 wherein the microfluidic device comprises an inkjet printhead and wherein the greater cross-section area is in the collinear air entry channel.

6. The microfluidic device of claim 5 wherein at least one greater cross-sectional area is in the collinear air exit channel.

7. The microfluidic device of claim 1 wherein the microfluidic device comprises an inkjet printhead and wherein at least one greater cross-sectional area is in the channel of the deflection air for the inkjet stream.

8. The microfluidic device of claim 1 wherein the microfluidic device comprises an inkjet printhead and wherein the greater cross-sectional area is in the inkjet stream collinear channel and is below the entry of the cross airflow.

9. The microfluidic device of claim 1 wherein said polymer has a rounded surface.

10. The microfluidic device of claim 1 comprising fluid channels wherein said channels comprise projections into at least part of the channel that serve as flow conditioning aids to effect laminar flow of fluid.

11. The microfluidic device of claim 10 wherein the projections to aid laminar flow comprise ribs.

12. The microfluidic device of claim 10 wherein the flow-aid projections to aid laminar flow comprise posts.

13. The microfluidic device of claim 10 wherein the microfluidic device comprises an inkjet printhead and wherein the projections to aid laminar flow are in the collinear airflow entry channel.

14. The microfluidic device of claim 10 wherein the projections to aid laminar flow have a pitch of between 125 and 500 per cm across the channel.

15. The microfluidic device of claim 10 wherein the microfluidic device comprises an inkjet printhead and wherein the flow-aid projections to aid laminar flow are in the entry channel for directional airflow.

16. The microfluidic device of claim 11 wherein there is a gap of between 60 and 15 micrometers between the ribs.

17. The microfluidic device of claim 11 wherein the ribs have a length of between about 25 and 500 micrometers.

18. The microfluidic device of claim 1 wherein the channel is greater in cross-section because the rectangular notch includes a series of notches at the change of direction of the channel.

19. The microfluidic device of claim 1 wherein said fluid channels comprise at least one screen to aid laminar flow.

20. The microfluidic device of claim 10 wherein the projections to aid laminar flow have a pitch of between 20 and 80 micrometers across the channel.

21. The microfluidic device of claim 10 wherein projections to aid laminar flow is in the entry channel for directional airflow.

22. The microfluidic device of claim 10 wherein there is a gap of between 60 and 15 micrometers between the projections.

23. The microfluidic device of claim 1 wherein the microfluidic device is an inkjet printhead.

24. The microfluidic device of claim 10 wherein the microfluidic device comprises an inkjet printhead and wherein at least one of said channels is provided with a screen to promote laminar flow.

* * * * *